US007124593B2

(12) United States Patent
Feher

(10) Patent No.: US 7,124,593 B2
(45) Date of Patent: Oct. 24, 2006

(54) TEMPERATURE CONDITIONING APPARATUS FOR THE TRUNK OF A HUMAN BODY

(76) Inventor: Steve Feher, 1 Keahole Place, Suite 1505, Honolulu, HI (US) 96825-3414

( * ) Notice: Subject to any disclaimer, the term of this patent is extended or adjusted under 35 U.S.C. 154(b) by 279 days.

(21) Appl. No.: 10/651,628

(22) Filed: Sep. 2, 2003

(65) Prior Publication Data

US 2005/0066401 A1 Mar. 31, 2005

(51) Int. Cl.
*F25B 21/02* (2006.01)

(52) U.S. Cl. ..... 62/3.5; 62/259.3

(58) Field of Classification Search ..... 62/3.5, 62/3.2, 3.3, 3.6, 6, 259.3, 238.2, 238.7
See application file for complete search history.

(56) References Cited

U.S. PATENT DOCUMENTS 5,605,144 A * 2/1997 Simmons et al. ..... 126/204
5,755,110 A * 5/1998 Silvas ..... 62/259.3
5,970,519 A * 10/1999 Weber ..... 2/81
5,976,176 A * 11/1999 Webb, II ..... 607/104
6,085,369 A * 7/2000 Feher ..... 5/423
6,276,155 B1 * 8/2001 Siman-Tov et al. ..... 62/259.3
6,298,907 B1 * 10/2001 Colvin et al. ..... 165/46
6,341,384 B1 * 1/2002 Hayes ..... 2/458
6,349,412 B1 * 2/2002 Dean ..... 2/102
6,427,476 B1 * 8/2002 Eddins ..... 62/457.2
6,519,782 B1 * 2/2003 Collins et al. ..... 2/463
6,543,247 B1 * 4/2003 Strauss ..... 62/259.3
6,551,347 B1 * 4/2003 Elkins ..... 607/104

* cited by examiner

*Primary Examiner*—Mohammad M. Ali
(74) *Attorney, Agent, or Firm*—Robert J. Lauson; Lauson & Associates

(57) ABSTRACT

A temperature conditioning apparatus for the human body includes a vest or other clothing unitary with a thermoelectric or Stirling cycle heat pump worn by the user. The unit is powered by a battery source worn on the user's belt or other part of his or her body, or by an externally-mounted electrical energy source, for example, in a vehicle. The vest has front and rear panels with an air flow layer and permeable inside layer that accept and release conditioned air to the user. The vest may be used with body armor or other protective layers, that is, the vest may be worn underneath body armor or body armor may be built into the vest, or the vest may be used without body armor to cool the user in an exceptionally hot environment such as a non-air conditioned space in hot weather.

8 Claims, 2 Drawing Sheets

FIG. 1
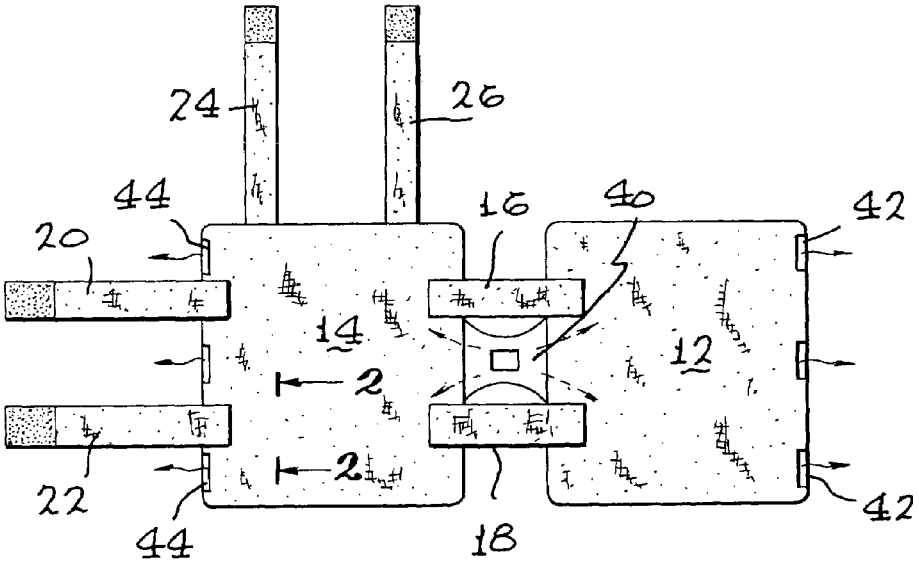
FIG. 2
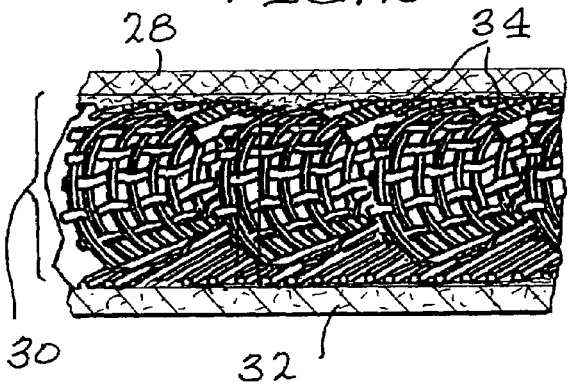
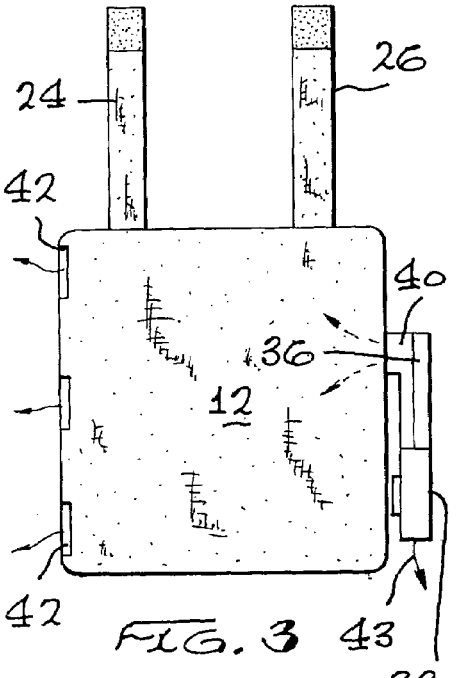
FIG. 3
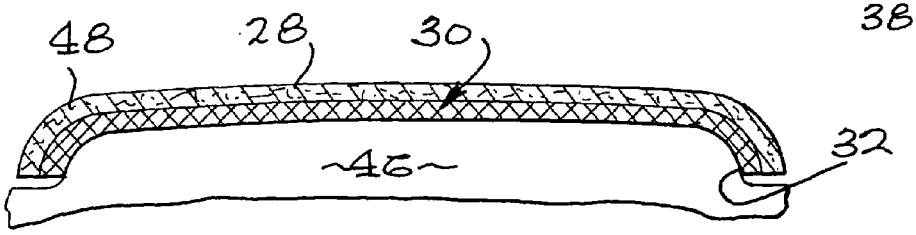
FIG. 4

TEMPERATURE CONDITIONING APPARATUS FOR THE TRUNK OF A HUMAN BODY

BACKGROUND

1. Background of the Invention

The present invention relates generally to apparatus for selectively heating or cooling the human body trunk which is adapted to be worn under outer protective equipment or clothing items such as a so-called bulletproof vest or jacket, fireman or firefighter garb, bio/chemical protective suit, or the like.

2. Description of Related Art

In many situations an individual may find it necessary or highly desirable to wear protective gear such as a bulletproof vest for a policeman or fire protection gear for a fireman, for example. Such gear, although highly useful and even life protecting, is uncomfortable when worn for a length of time especially during warm or humid weather.

It is therefore a desideratum to provide a means and method of supplementing protective gear with cooling/heating equipment that alleviates uncomfortable aspects of wearing the gear resulting from an increase or decrease in the wearer's temperature while wearing the gear.

SUMMARY OF THE INVENTION

In accordance with the practice of the present invention there is provided temperature modification equipment which is securable about the trunk of a human being and can be worn underneath outer protective clothing or gear.

According to another object the temperature modification equipment and the protective clothing or gear are unitarily related and worn as a single unit by an individual.

In yet other objects the temperature modification equipment is powered by a battery source mounted to a belt means worn by the wearer of the temperature modification equipment, or battery pack mounted to other parts of the wearer's body, or externally provided electrical energy source (e.g., in a vehicle).

A still further object provides a thermoelectric heat pump for utilization as a cooling or heating means in the described temperature modification equipment.

Yet another object is the provision of a Stirling cycle heat pump to serve as a cooling means.

BRIEF DESCRIPTION OF THE DRAWING

These and other objects of the present invention will become more readily apparent upon reading the following detailed description and upon reference to the attached drawings in which:

FIG. 1 is an elevational view of a first embodiment of a temperature conditioned garment of the invention shown in extended relation;

FIG. 2 is a sectional view taken along line 2—2 of FIG. 1;

FIG. 3 is a rear elevation of FIG. 1;

FIG. 4 is a top plan, sectional view showing the first embodiment of the invention and protective gear added;

DESCRIPTION OF PREFERRED EMBODIMENTS

Figure 5:
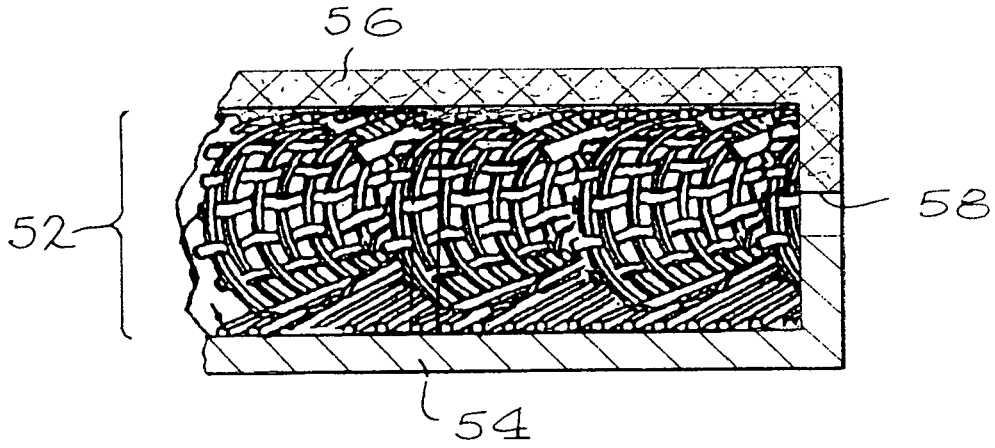
FIG. 5 is a sectional view similar to FIG. 2 of a second embodiment incorporating a protective layer incorporated within each panel.

For the ensuing description of the invention, reference is made to the drawing and particularly FIG. 1 where a vestlike arrangement 10 is shown. Specifically, the arrangement 10 includes a generally rectangular front panel 12 which is dimensioned to extend and cover the front part of a wearer's body from the shoulders down to the lower waist and transversely from one side of the body to the other. Although not shown, the front panel can be specially contoured to adapt to either a male or female. A back panel 14 preferably constructed in the same manner and dimensions as the front panel 12 is interconnected with the front panel by first and second flexible right side straps 16 and 18 that are end connected to the two panels. A further pair of flexible straps 20 and 22 each have one end secured to the back panel 14 and the outer ends thereof are removably secured to the front panel such as by a so-called Velcro means, for example. Still further, a pair of flexible spaced apart shoulder straps 24 and 26 have one end of each secured to what is a top edge of the back panel 14 and the other ends are removably attached to what is a forward facing surface of the front panel by a suitable means such as a Velcro connector.

In use, the arrangement 10 is worn by an individual and removably secured in place by the shoulder straps 20 and the right side straps 16 and 18 thereby comfortably positioning the front panel across and contacting the chest of the wearer while at the same time the back panel 14 is contiguous with the back of the wearer. In a way that will be more specifically described, the front and back panels will be cooled or heated, as the case may be, which will result in the contacted body parts being correspondingly cooled or heated, as the case may be, and thus the entire body.

Turning to FIG. 2, each of the panels includes a flexible outer layer 28 made of an air impermeable material, an inner air flow layer 30 and an inwardly facing layer 32 constructed of an air permeable material. The air flow layer 30 is preferably constructed of a plurality of generally cylindrical tubes 34 in side by side relation, each tube formed by woven fibers and the individual tubes held together in a layer by further fibers transversely woven through the tubes. Such a layer 28 is capable of readily transmitting air along the axes of the tubes 34 (i.e., primarily from one side of a panel 12, 14 to the other) and allowing air transfer to a lesser extent transversely of the tubes. A satisfactory woven tubular material from which a layer 28 can be made is manufactured by Pittsfield Weaving Inc., Pittsfield, N.H. and sold under the trade designation 9006-007-1.

Turning now to FIG. 3, to accommodate the readily apparent restricted space and weight requirements imposed by the invention, it is preferable that a heat pump 36 for cooling or heating to provide the temperature conditioning of the invention be an electrically powered thermoelectric device. For the following discussion of operation, it will be assumed that "cooling" is being achieved.

With appropriate polarity of electrical interconnection, the heat pump 36 produces a "cold" region of the pump and an electrical fan 38 directs a stream of air across the "cold" region having heat exchanger elements (e.g., fins, pins) effecting cooling of the air stream after which the so-cooled air moves via a manifold 40 into and through the layers 30 of both the front and back panels 12 and 14. The cooled air exits the back panel 12 via a plurality of vents 42 arranged along the panel left side. Similarly, the pressurized cooled air after passing through the front panel 14 empties into the ambient air via vents 44 spaced apart along the front panel left side (FIG. 1). The cooled air passing through layers 30 results in cooling of the inwardly facing layer 32 (as well as passing therethrough) and thus cooling the individual wearing the arrangement. The manifold 40 constructed of relatively bendable plastic, as its name suggests, is a hollow conduit interconnecting with the heat pump 36 to receive cold pressurized air and pass it to and through the air flow layers 30, and also use a portion of the pressurized uncooled air to remove waste heat of the pump to the ambient as shown by the arrow 43 (FIG. 3).

As shown best in FIG. 4, when used in combination with protective gear such as a bulletproof vest, for example, the arrangement 10 is first put on by an individual 46 as described in the immediately preceding paragraphs, following which a bulletproof vest 48 (shown schematically) is placed over the underlying arrangement 10 in the same general manner in which it would be worn if there were no cooling apparatus. Since bulletproof vests are available in a variety specific constructions, such a vest is shown schematically in FIG. 4 as presenting front and back layers 48 to protect the body against gunfire from the front and rear.

For the ensuing description of a second embodiment of the invention in which the protective garment and temperature conditioning are unitarily related into a single garment 50, reference is made to FIG. 5. The temperature conditioning apparatus includes an air flow layer 52 which can be identical to to the layer 30 of the first described embodiment and an inner air permeable layer 54 that is contemplated to face toward and contact the individual 46 when worn. As in the first embodiment, the layers 52 and 54 are arranged to form two panels, namely, a front panel and a back panel. Instead of a further air impermeable layer as in the first embodiment, a bulletproof layer 56 that is also air impermeable encloses the outer surface of the air flow layer 52 of each panel and is edge secured thereto in a manner preventing the temperature conditioned air from escaping from the layer 52 except at one or more vents 58 located at the edges of the front and back panels and through layer 54. Shoulder and side straps are provided for aiding in wearing the overall garment as first earlier described. An advantage of this embodiment is that the overall garment is lighter and less bulky in that an outer covering layer has been eliminated and separate tie straps for the bulletproof garment or layer 56 may also be eliminated, in some cases.

Figure 6:
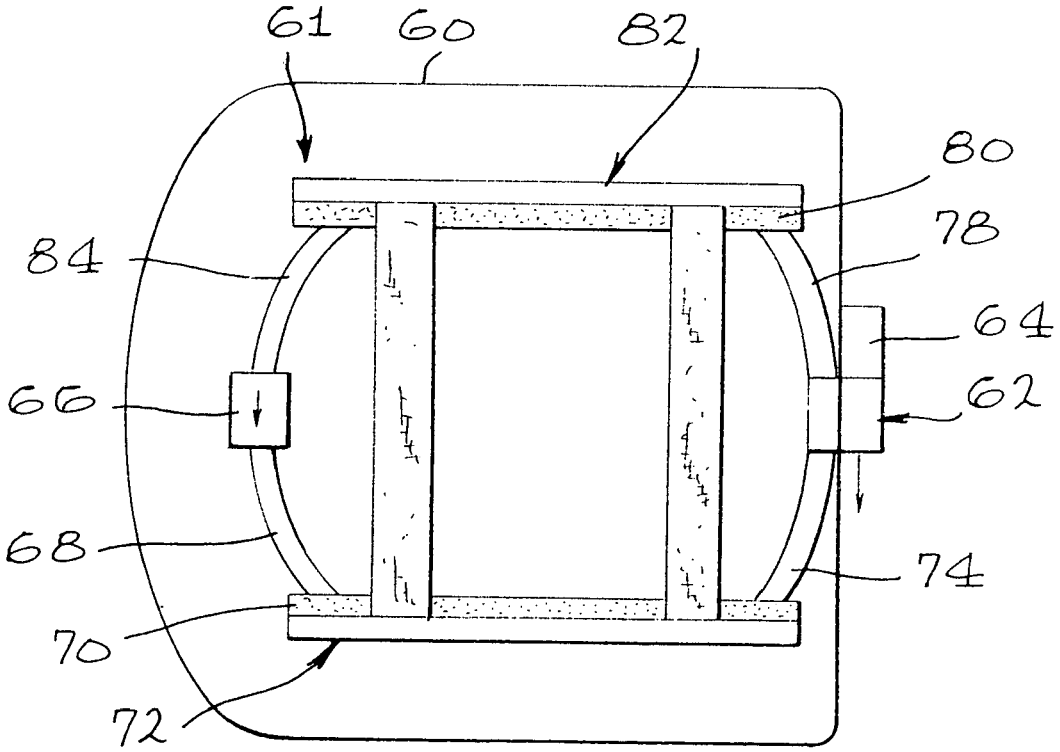
FIG. 6 is sectional view of a third embodiment especially adapted for use with biological or chemical warfare protection gear.

As a still further version, reference is made to FIG. 6 where the invention is utilized in connection with a protective garment 60 that completely encloses the wearer from the ambient such as in biological and chemical warfare gear. A vestlike arrangement 61 is located within the garment 60 and includes a cooling/heating apparatus 62 that is preferably a thermoelectric device mounted with a first blower apparatus 64 located outside the protective garment 60 for removing waste heat. Assuming cooling is desired, the apparatus cooling region has a main heat exchanger 61 located within the protective garment 60. A second blower apparatus 66 located within the garment 60 moves pressurized air along a conduit 68 through an air flow layer 70 in a back panel 72 (which can be constructed as the version shown in FIG. 2), an air duct 74 to and past the main heat exchanger 61 of the heat pump, via a further air duct 78, through an air flow layer 80 in a front panel 82 and returning to the second blower apparatus via yet another air duct 84. In general operation, conditioned air is circulated and recirculated through that part of the arrangement 61 within protective garment 60 while at the same time waste heat is directly emptied into the ambient all of this being achieved without impairing the integrity of the protective garment 60.

Although the invention has been described with respect to certain embodiments, it is to be understood that those skilled in the appertaining arts may suggest modifications that come within the spirit of the invention as described and shown and within the ambit of the appended claims.

What is claimed is:

1. Apparatus adapted to be worn by a human being for selectively modifying the temperature of the human being, comprising:

a front panel and a back panel;

means for removably securing said panels about a human being such that the front panel contactingly covers approximately the entire forward facing part of the human trunk and the back panel contactingly covers approximately the entire human back region from the shoulders to the waist;

each panel includes an air flow layer, a first air impermeable layer substantially covering a first side of the air flow layer facing away from a wearer, and a second air permeable layer substantially covering a second side of the air flow layer generally facing a wearer;

means for sealing edge portions of the first and second layers to one another except for at least one vent located along a first sealed edge portion of each panel; and a thermoelectric heat pump interconnected with the front and back panels at a second sealed edge portion for passing a pressurized stream of temperature conditioned air through the respective air flow layers to exit to ambient via the vents.

2. Apparatus as in claim 1, in which the heat pump is a Stirling cycle device when the conditioned air is being cooled.

3. Apparatus as in claim 1, in which the removable securing means includes at least one strap for receipt over the shoulders of the wearer and at least one further strap extending about the waist of a wearer.

4. Apparatus as in claim 1, in which there are further provided first and second bulletproof protective panels worn by a wearer outside and over the front and back panels respectively.

5. Apparatus adapted to be worn by an individual which simultaneously protects the individual against gunfire and selectively cools or warms the individual, comprising:

a front panel and a back panel;

at least one strap end connected to both panels for receipt over the shoulder allowing the panels to hang downwardly therefrom;

at least one further strap interrelating the panels to one another and securing them transversely;

each panel including in the order described an inner layer facing inwardly toward the individual wearer, an air flow layer, and an outer layer protective against gunfire;

means for sealing the layers of each panel at their outer edges except for at least one vent; and a thermoelectric heat pump interconnecting pressurized temperature conditioned air via a manifold to the air flow layer of each panel for passing therethrough and outwardly through the vents to ambient.

6. Apparatus as in claim 5, in which the air vents are of such dimensions as to create a relatively light back pressure within the air flow layers so that the conditioned air spreads throughout the air flow layers.

7. Apparatus worn by a human for conditioning the temperature while providing protection against agents in ambient which are harmful to touch or breathe, comprising:

an enveloping garment completely enclosing the wearer and preventing access of harmful ambient agents to the garment interior;

first and second panels arranged about the wearer located inside the garment, each panel including an air flow layer; and a thermoelectric heat pump with a first blower emptying waste heat to exterior of the enveloping garment and a second blower located within the garment recirculating temperature conditioned air through the air flow layers and to the interior of the garment.

8. Apparatus as in claim 7, in which the heat pump operates on a Stirling cycle.

* * * * *